United States Patent [19]

Smith, Jr.

[11] Patent Number: 4,727,609

[45] Date of Patent: Mar. 1, 1988

[54] SURVIVAL TOOL

[76] Inventor: Frederick A. Smith, Jr., 1026 N. Woodbine, Oak Park, Ill. 60302

[21] Appl. No.: 839,905

[22] Filed: Mar. 14, 1986

[51] Int. Cl.[4] ..... B26B 11/00; B25F 1/00; F41B 5/00

[52] U.S. Cl. ..... 7/145; 7/158; 7/170; 124/25

[58] Field of Search ..... 7/143–148, 7/158, 159, 161, 163–164, 169–170, 116, 106; 30/125, 151, 342; 81/490; 124/25, 20 R; D8/105; D22/101, 107

[56] References Cited

U.S. PATENT DOCUMENTS

| | | | |
|---|---|---|---|
| 102,677 | 5/1870 | Gregory . | |
| 199,787 | 1/1878 | Buskett | 7/116 X |
| 302,097 | 7/1884 | Call . | |
| 810,987 | 1/1906 | Spicer . | |
| 872,271 | 11/1907 | Benet . | |
| 1,882,288 | 10/1932 | Lee | 7/116 |
| 2,105,239 | 1/1938 | Bachtold | 30/151 |
| 2,278,535 | 4/1942 | Dobson | 124/25 |
| 2,377,730 | 3/1943 | Vosbikian et al. | 7/16 |
| 2,651,106 | 9/1953 | Breitzke | 30/125 |
| 3,269,380 | 8/1966 | Stevens | 124/25 |
| 3,760,438 | 9/1973 | White | 7/158 X |
| 3,824,641 | 7/1974 | Shandel | 7/14.55 |
| 4,002,236 | 1/1977 | Tolleson | 206/577 |

FOREIGN PATENT DOCUMENTS

| | | | |
|---|---|---|---|
| 3418783 | 12/1984 | Fed. Rep. of Germany | 7/158 |

*Primary Examiner*—Debra Meislin

*Attorney, Agent, or Firm*—Fitch, Even, Tabin & Flannery

[57] ABSTRACT

A survival tool having a multi-function tool head secured to an elongated hollow shaft. The tool head includes a shovel blade portion with a marginal edge terminating at a rectilinear shoulder portion that is attached to the hollow shaft. An axe blade is formed in one piece with the shovel blade so as to be substantially coextensive with the shoulder portion of the shovel. The cutting edge of the axe blade is substantially continuous with the portion of the marginal edge of this shovel adjacent the shoulder portion. A hammer is formed in one piece with the shovel and axe that has a striking face extending outwardly from the shovel blade adjacent the shoulder portion thereof opposite the cutting edge of the axe. The hollow shaft includes a transverse slot adjacent the tool head which is sized to slidably receive a one-piece bow. An adjustable pressure plate within the hollow shaft engages the central portion of the bow to secure the bow in place. The end of the hollow shaft opposite the tool head is closed by a tubular handle that holds a removable knife blade.

4 Claims, 11 Drawing Figures

SURVIVAL TOOL

BACKGROUND OF THE INVENTION

The present invention relates to a multifunction survival tool and, more particularly, to a survival tool that includes an improved, integral, combination tool head.

Over the years there have been proposed a great number of survival or multi-function tools for, e.g., campers, hikers, sailors, military personnel and others who may want a relatively compact and lightweight multi-function implement for use under circumstances where there is not access to all of the different tools needed to perform various tasks. Many conflicting goals have affected the design of survival tools. For example, it is desirable that such tools be extremely compact so as to be conveniently and unobtrusively transported until such time as needed. Yet, the tool should be able to perform an innumerable variety of tasks. It is desirable that a survival tool be lightweight, yet have high structural strength to withstand rugged use. Further, while one should be able to use the survival tool for a great variety of tasks, the tool itself should be adaptable to such uses with a minimum amount of simple assembly or adjustment.

Accordingly, it is an object of the present invention to provide a multi-function tool that is compact, yet allows easy, independent use of the different tools.

It is an additional object to provide a survival tool that requires a minimum amount of assembly and adjustment to adapt the tool to perform its various functions.

These objects, and others that will become apparent upon reference to the following detailed description and accompanying drawings, are provided by a survival tool having a multi-function tool head secured to an elongated hollow shaft. The tool head includes a shovel blade portion with a marginal edge terminating at a rectilinear shoulder portion that is attached to the hollow shaft. An axe blade is formed in one piece with the shovel blade so as to be substantially coextensive with the shoulder portion of the shovel. The cutting edge of the axe blade is substantially continuous with the portion of the marginal edge of the shovel adjacent the shoulder portion. A hammer is formed in one piece with the shovel and axe and has a striking face extending outwardly from the shovel blade adjacent the shoulder portion thereof opposite the cutting edge of the axe. The hollow shaft includes a transverse slot adjacent the tool head which is sized to slidably receive a one-piece bow. An adjustable pressure plate within the hollow shaft engages the central portion of the bow to secure the bow in place and the end of the hollow shaft opposite the tool head is closed by a tubular handle that holds a removable knife blade.

DETAILED DESCRIPTION OF THE PREFERRED EMBODIMENT

Figure 1:
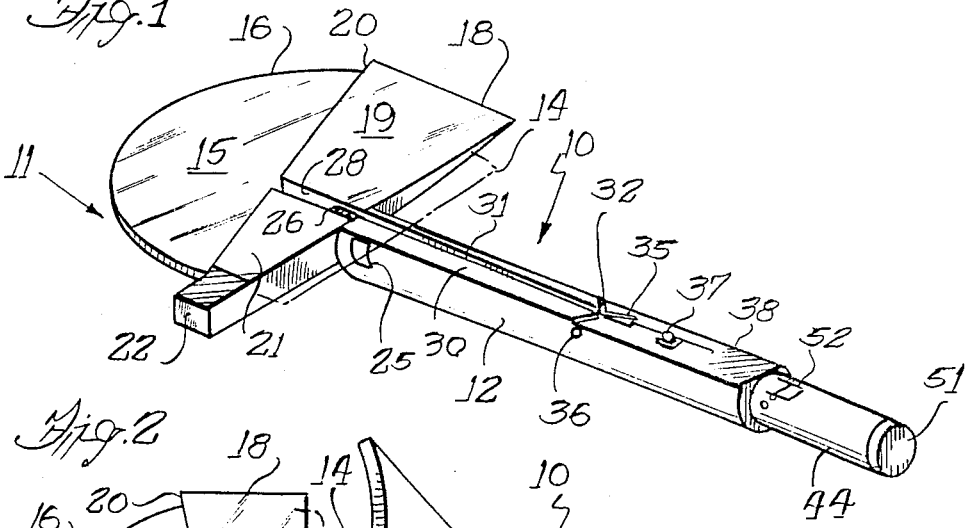
FIG. 1 is a perspective view of the multi-function survival tool of the present invention in which components of various tools are stored within the hollow handle of the tool.

Turning to the figures of the drawings, which are for purposes of illustration and not limitation, there is seen a multi-function survival tool, generally indicated by 10, embodying the present invention. The tool 10 includes a tool head 11 that forms one aspect of the invention and which is secured to the end of an elongated shaft 12 that serves as a handle for the tool 10. As illustrated, the shaft or handle 12 is hollow and receives a projection 13 on the tool head 11 (best seen in FIG. 6) to securely hold the tool head 11 onto the shaft 12. The tool head 11 is of a unique, one-piece, compact design, having a central rectilinear shoulder portion 14, common to all the tools, that receives the handle 12. When viewed in planform, as in FIG. 2, the shape of the tool head is predominantly defined by a shovel blade 15 having a curvilinear marginal edge 16 substantially terminating at the outer edges of the shoulder portion 14 of the tool. One half of the shoulder 14 tapers from the handle 12 toward the edge 16 of the shovel blade 15 to define the cutting edge 18 of the axe blade 19. The edge 18 of the axe 19 is substantially continuous with the marginal edge 16 of the shovel blade 15, the only discontinuity being the small corner 20 that defines one end of the sharpened edge 18 of the axe 19. The half of the shoulder 14 opposite the axe 19 includes a hammer 21 having a striking face 22 that extends outwardly from the marginal edge 16 of the shovel blade 15 a distance sufficient to allow use of the striking face 22 unobstructed by edge 16 of the shovel blade 15. Thus configured, the tool head 11 essentially takes up no more space than would be required for the shovel blade 15 alone, yet the separate elements of the tool head 11 require no adjustment or assembly and can be used independently from each other to provide the advantages that would accrue to each tool separately.

Figure 2:
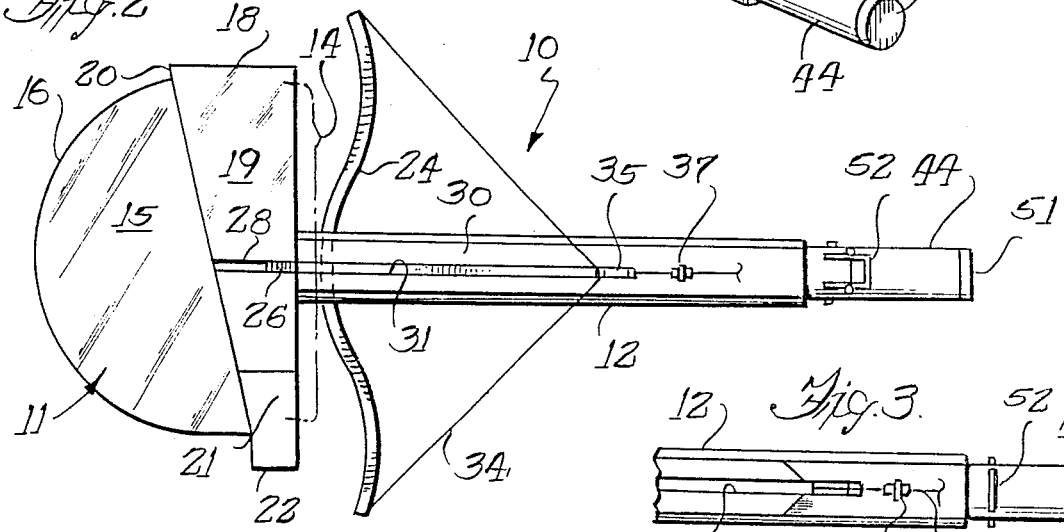
FIG. 2 is a plan view of the survival tool of FIG. 1 with a crossbow in operative association therewith.
Figure 3:
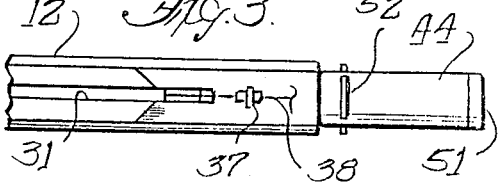
FIG. 3 is a fragmentary portion of the plan view of a portion of FIG. 2 showing the handle portion of the hollow shaft including sight and trigger means.
Figures 6, 7, 8, 9, 10, 11:
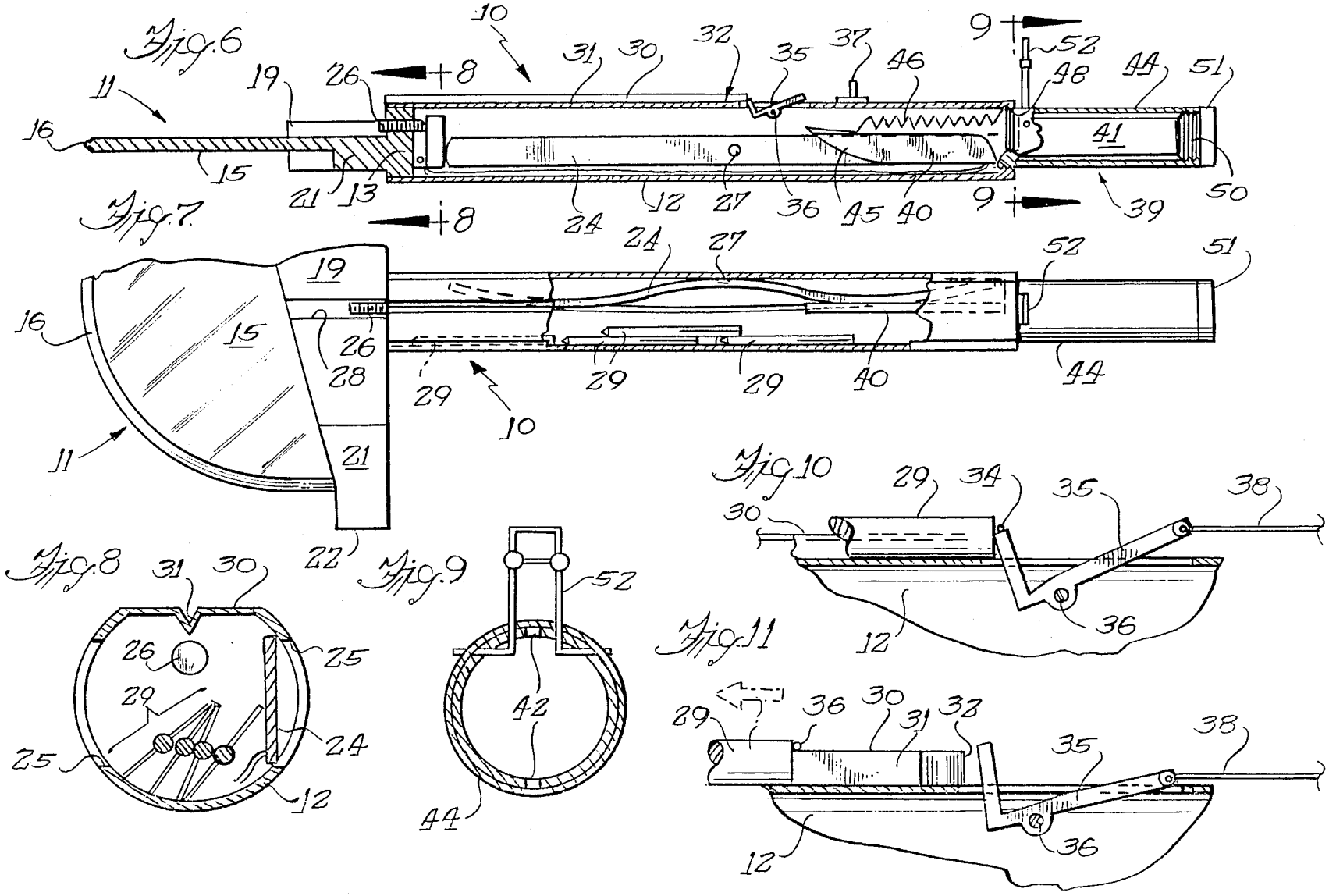
FIG. 6 is a cross-sectional view taken along the longitudinal axis of the hollow shaft that forms the handle of the tool.
FIG. 7 is a fragmentary plan view of the assembled tool, partially broken away to show detail.
FIG. 8 is a cross-sectional view taken substantially along line 8—8 of FIG. 6.
FIG. 9 is a cross-sectional view taken substantially along line 9—9 of FIG. 6.
FIGS. 10 and 11 are enlarged, fragmentary cross-sectional views showing details of the trigger mechanism.

Another aspect of the invention is the provision of an improved disassemblable crossbow integral with the multi-function tool head 11 and handle 12. (Such a crossbow may prove to be of great utility in a survival tool for purposes of hunting game or for self-defense.) As best seen in FIGS. 6–8, the individual elements of the crossbow system are sized to fit within the hollow shaft or handle 12 of the survival tool 10 when not in use. The system includes a one-piece bow 24 that, when assembled, is received in a transverse slot 25 in the hollow shaft 12 adjacent the tool head 11. Once the bow 24 is centered in the slot 15 (as seen in FIG. 2), it is secured in place by a threaded bolt 26 received in the projection 13 on the tool head 11 and extending into the interior of the hollow shaft so that the end of the bolt 26 forms a pressure plate that engages the bow 24 to frictionally hold the bow in place. The bolt 26 is received in a recess 27 in the bow 24, which ensures that the bow is centered with respect to the handle 12 when engaged by the bolt 26. To facilitate its adjustment, the head of the bolt 26 is accessible from the exterior of the tool handle 12 and, as illustrated, is located in a groove 28 in the shoulder portion 14 of the tool head.

To guide the arrows (such those indicated by 29, which are sized to be easily stored within the hollow shaft 12), the flattened top 30 of the shaft 12 includes an axial groove 31 that receives a single arrow 29, as best seen in FIGS. 10 and 11. The flat top 30 includes a shoulder 32 that serves to hold the nocking point of the bowstring 34 when it is in its drawn position, as seen in FIGS. 2 and 10. To release the bowstring 34 and fire the arrow 29, a trigger 35 pivotally mounted in the shaft 12 on a pin 36 adjacent the shoulder, lifts the nocking point of the drawn bowstring 34 over the shoulder 32 to fire the arrow 29, as best seen in FIGS. 10 and 11. The trigger 35 may include a trip wire 38 attached thereto and threaded through an eyelet 37 on the top 30 of the handle 12 to permit remote actuation of the trigger 35.

Figure 4:
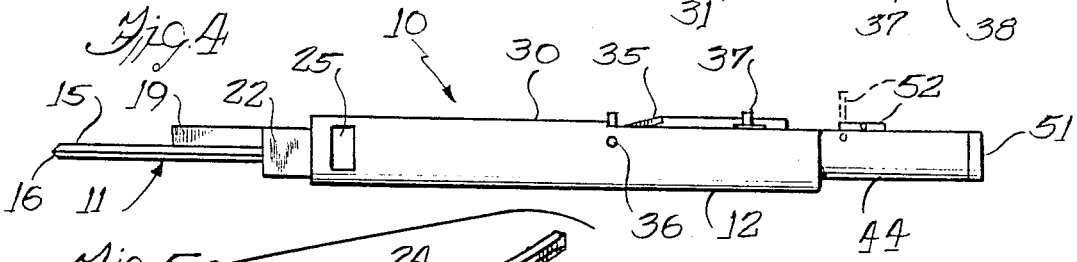
FIG. 4 is a side elevation of the tool of FIG. 1.
Figure 5:
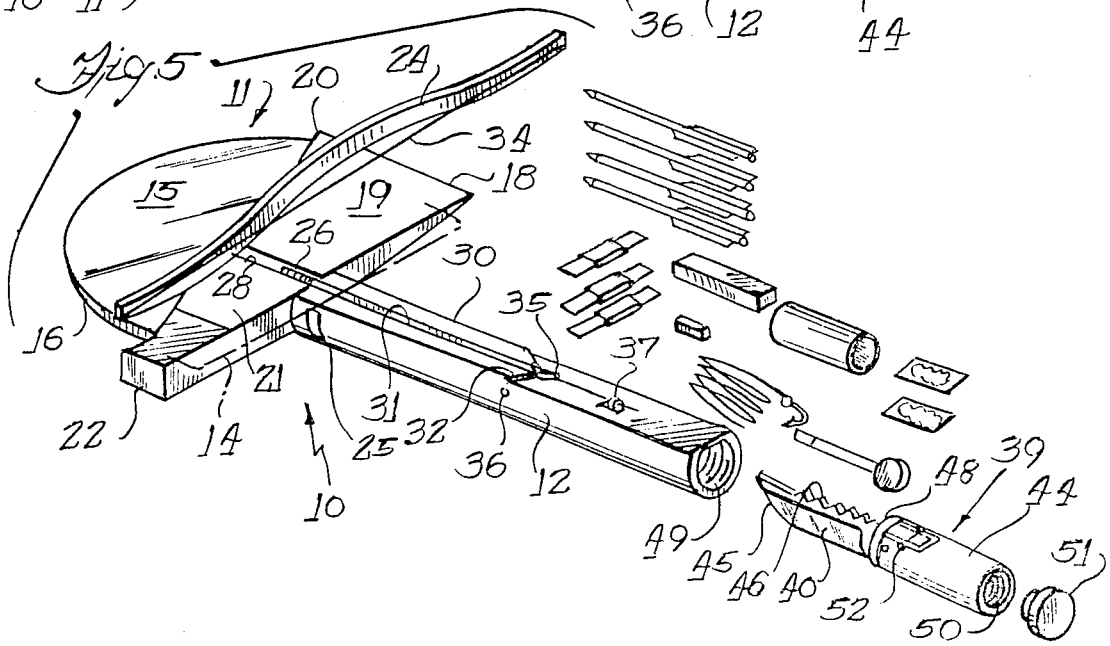
FIG. 5 is an exploded perspective view of the tool of FIG. 1 in its disassembled state, showing the various components that make up the tool and various items that may be stored within the hollow shaft.

An additional aspect of the invention is the provision of the end of the handle 12 opposite the tool head 11 with a removable knife, generally indicated by 39 and best seen in FIGS. 5–7. The knife 39 includes a blade 40 with its tang 41 slidably received in diametrically-opposite slots 42 (FIG. 9) on the interior of a cylindrical handle portion 44. The knife blade 40 has a cutting edge 45 and a sawtooth edge 46 and is sized in width to be received on the interior of the handle 12, with screw threads 48 on the exterior of the handle 44 cooperating with screw threads 49 on the interior of the handle 12 which permit selective removal of the knife 39 from the handle 12. The handle 44 also has a closed, recessed end 50 opposite the blade 40 that threadably receives a removable compass 51. With knife blade 40 and tang 41 removed from the handle 44, the handle 44 may be used as a cup for, e.g., drinking. Attached to the handle 44 adjacent the external threads 48 is a sight 52 that is pivotable between a first position in which it is substantially perpendicular to the handle 44 (as best seen in FIGS. 6 and 9) and a second position in which the sight lies substantially flat against the handle (as best seen in FIGS. 2 and 4). In its first, perpendicular position, the sight 52 serves to assist in aiming the crossbow 24, with the sight 52 is folded to its second position when the bow is not being used. Additionally, the sight 52 can serve as a grip for the handle 44 of the knife 39 when the handle 44 is used as a cup, as described above.

Thus, it can be seen that a multi-function survival tool has been provided that is compact and requires little or no assembly, while being able to be used to perform a great number of different tasks. While the invention has been described in terms of a preferred embodiment, there is no intent to limit the invention to the same. On the contrary, it is intended to cover all equivalents and modifications within the scope of the appended claims.

What is claimed is:

1. A survival tool comprising a multi-function tool head secured to an elongated hollow shaft, the end of the hollow shaft opposite the tool head being selectively closable by a tubular handle closed at one end and receiving a removable knife blade means in the opposite, open end, the knife blade means being sized to be received within the elongated shaft, the closed end of the tubular handle being recessed so as to removably receive compass means, the elongated hollow shaft having a transverse slot therethrough adjacent the tool head and sized to slidably receive a one-piece bow therethrough, adjustable pressure plate means disposed within the hollow shaft so as to engage the bow to secure it in place and sight means for the bow pivotally received in the tubular handle portion so as to be foldable to lie substantially against the surface of the tubular handle when the sight means is not in use.

2. A survival tool apparatus comprising:

an elongated hollow shaft having first and second ends and defining a transverse bow-receiving slot extending through said shaft adjacent the first end thereof and being sized to slidably receive a one-piece bow therethrough, said hollow shaft further defining a tool-receiving cavity for storing the one-piece bow and a plurality of discrete tool members therein, said hollow shaft further having a longitudinal axis and defining an arrow-guiding recess on its outer surface generally parallel to said longitudinal axis;

a multi-function tool head including plug-like means receivable in the first end of said hollow shaft for securement thereto and having an end wall immediately adjacent said bow-receiving slot, said plug-like means substantially enclosing said first end of said hollow shaft to retain said tool members in the cavity thereof, said tool head further including shovel means having a blade portion with a marginal edge terminating at a shoulder portion of an axe means formed in one piece with the shovel means, said shoulder portion forming a substantially obtuse angle with the axis of said hollow shaft, and having a length substantially coextensive with said shovel means, said axe means having a cutting edge substantially continuous with a portion of the marginal edge of said shovel means, and defining an arrow-guiding recess substantially continuously extending from and aligned with the arrow-guilding recess of said shaft, said tool head further including hammer means formed in one piece with said shovel and said axe means and having a striking face outwardly extending from the marginal edge of said shovel means adjacent said shoulder portion so as to generally oppose said cutting edge of said axe means; and end cap means engageable with said second end of said shaft so as to substantially enclose said second end of said tubular shaft to retain the plurality of tool members in said hollow shaft.

3. The apparatus of claim 2 wherein said plug-like means of said tool head defines screw-receiving threaded recess means generally parallel to the axis of said hollow shaft, and said apparatus further comprising screw-locking means receivable in said threaded recess and extending to said bow-receiving recess so as to engage and lock said bow with respect to said hollow shaft.

4. The apparatus of claim 3 wherein said end cap means comprises a medial portion of a knife means including a knife blade extending within said hollow shaft and a handle portion external to said hollow shaft and generally axially aligned therewith.

* * * * *